US006158414A

United States Patent [19]

Ma

[11] Patent Number: 6,158,414

[45] Date of Patent: Dec. 12, 2000

[54] MODE CONTROL FOR LEAN BURN ENGINES

[75] Inventor: Thomas Tsoi-Hei Ma, Ferrers, United Kingdom

[73] Assignee: Ford Global Technologies, Inc., Dearborn, Mich.

[21] Appl. No.: 09/297,898

[22] PCT Filed: Nov. 10, 1997

[86] PCT No.: PCT/GB97/03080

§ 371 Date: May 10, 1999

§ 102(e) Date: May 10, 1999

[87] PCT Pub. No.: WO98/21461

PCT Pub. Date: May 22, 1998

[30] Foreign Application Priority Data

Dec. 11, 1996 [GB] United Kingdom ..... 9623517

[51] Int. Cl.[7] ..... F02D 11/10; F02D 41/04

[52] U.S. Cl. ..... 123/336

[58] Field of Search ..... 123/336, 442

[56] References Cited

U.S. PATENT DOCUMENTS

| | | | |
|---|---|---|---|
| 3,738,341 | 6/1973 | Loos . | |
| 5,353,776 | 10/1994 | Burrahm et al. . | |
| 5,746,176 | 5/1998 | Damson et al. | 123/336 |

FOREIGN PATENT DOCUMENTS

| | | |
|---|---|---|
| 37 20 097 | 1/1988 | Germany . |
| 5-180038 | 7/1993 | Japan . |
| WO9621097 | 6/1996 | WIPO . |

*Primary Examiner*—Andrew M. Dolinar
*Attorney, Agent, or Firm*—Allan J. Lippa

[57] ABSTRACT

An intake system with multiple throttles, arranged in series, is disclosed for use in a lean burn, gasoline engine. The arrangement has the facility to provide air-fuel ratios which are: leaner than stoichiometric at the light load region of the operating map, stoichiometric at the high load region of the operating map, and richer than stoichiometric at the full load region of the operating map.

13 Claims, 2 Drawing Sheets

MODE CONTROL FOR LEAN BURN ENGINES

FIELD OF THE INVENTION

The present invention relates to mode control of a lean burn engine. Because lean burn operation can only be adopted in part of the operating range of an engine, even lean burn engines must on occasions be operated in a stoichiometric or rich mode and the invention is concerned with making mode changes as imperceptible as possible to the driver.

BACKGROUND OF THE INVENTION

In lean burn engines, it is necessary under certain engine conditions to change the fuel calibration from stoichiometric AFR (air to fuel ratio) to lean AFR or vice-versa. This may occur during driving when the engine speed/load operating point is moved into or out of a lean calibration window, and during lean cruise conditions when the engine AFR has to be perturbed briefly back to a rich AFR at regular intervals in order to purge a NOx trap in the exhaust system. The latter purge sequence could be very frequent, typically a 1 second rich excursion is required for every 30 seconds of lean cruise running.

A well known control problem with lean burn engines is that the AFR change can cause torque fluctuations which are unacceptable for driveability. This arises from the fact that the intake air mass drawn into the engine is fixed and is set by the driver's pedal position at a given vehicle speed. If the AFR calibration is to be suddenly changed against this fixed air mass, the fuel mass will change affecting the energy produced and the engine torque. For example, a change in AFR from stoichiometric to 22:1 represents a 35% drop in output torque at the same air mass.

To compensate for this sudden change, the fundamental requirement is that the intake air mass must in some way be changed at the same time as the AFR is changed, so that the fuel mass in the engine remains substantially the same before, during and after the AFR change.

In one way of achieving this in the prior art, it is left to the driver to respond to the perceived change in torque by moving the demand pedal to a new position to change the intake air mass thereby regaining the engine torque. In effect, the driver response is in this case built into the control loop, but this is only acceptable for small excursions in the engine torque.

In another method disclosed in the prior art, an electrically controlled throttle (ETC) is used to isolate the driver from direct interface with the engine throttle. The driver sets the torque demand with a potentiometer which the ETC translates into a throttle position precisely matching the air mass required before and after the AFR change. Thus during the AFR change, while the ETC rapidly moves the throttle from one position to a new position to change the intake air mass, the driver who sets the torque demand does not feel any change in the engine torque and therefore need not adjust his demand pedal position. This AFR change, being totally transparent to the driver, is then termed a seamless transition.

In WO96/21097, it is proposed to use an air dilution throttle in parallel with the main throttle and to gang the two throttles together to move at all times at the same throttle angle. An on/off valve is provided in series with the air dilution throttle to enable or disable the air dilution flow according to the lean or stoichiometric mode, respectively.

This switching method has been demonstrated to produce seamless transitions similar to those using ETC, and has advantages over ETC in that the ganged throttles are permanently connected to the demand pedal giving the driver direct control. Such a system has advantages of lower cost and higher reliability over the ETC system. It also lends itself particularly well to the operating sequence of purging an NOx trap by briefly flicking the on/off valve without moving the main throttle.

While the use of parallel throttles and an on/off valve in series with one of the two throttles is effective, it has disadvantages in that the air dilution throttle is a potential source of additional air leakage when both throttles are closed during engine idle operation, during which only a very small amount of air leakage is permissible. This has resulted in increased technical difficulties in the design of the throttles because, even in the case of a single throttle, the total air leakage can attain a critical level. Furthermore other design considerations, in addition to the control of air leakage, for example, throttle effort, sludge and ice protection, fail-safe regulations etc., that is applied to the main throttle must equally be applied to the air dilution throttle.

OBJECT OF THE INVENTION

The present invention seeks to mitigate the aforementioned problems associated with ganged throttles connected in parallel with one another.

SUMMARY OF THE INVENTION

According to the present invention, there is provided an intake system for a lean burn engine comprising a first throttle connected to a manifold leading to the intake ports of the engine cylinders, a second throttle connected in series with and upstream of the first throttle and linked for movement in synchronism with the first throttle, and a mode control means for changing between lean burn and stoichiometric modes by abruptly altering the pressure drop across the second throttle to transfer control of the effective through-flow cross-section of the intake system between the first throttle alone and the series combination of the two throttles.

In one embodiment of the invention, the mode control means is an on/off valve connected in parallel with only the second throttle.

In an alternative embodiment of the invention, the mode control means is an override mechanism for temporarily disengaging the linkage between the second throttle and the first throttle and fully opening the second throttle.

In contrast with the prior art method of connecting the air dilution throttle in parallel with the first throttle, the second throttle in the present invention is connected in series with the first throttle. In this case, the function of the first throttle is not affected in any way by the addition of the second throttle so that all the stringent design specifications for the intake system still remain satisfied within the existing design of the first throttle. Moreover the design specification for the second throttle can now be relaxed to a large extent making the whole system viable.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
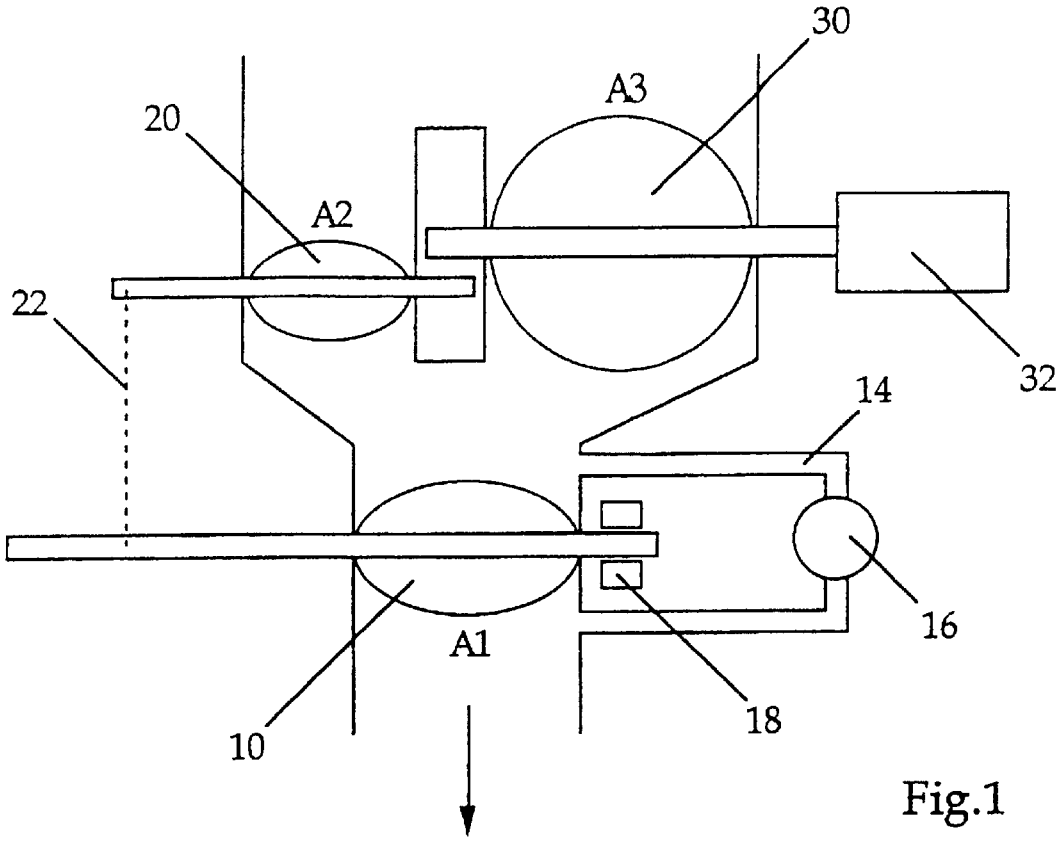
FIG. 1 is a block diagram of an intake system of a first embodiment of the invention.

The intake system shown in FIG. 1 has a first throttle 10 which is the main throttle normally to be found at the air intake end of the intake manifold. The first throttle 10 is connected to the demand pedal operated by the driver and is associated with a throttle position sensor 18. In the usual manner for a main throttle, a bypass passage 14 with an idle speed controller 16 is connected across the first throttle 10.

Upstream of the first throttle 10, a second throttle 20 and an on/off valve 30 are mounted in an extension of the housing of the first throttle 10. The second throttle 20 is linked for movement in synchronism with the first throttle 10, the linkage being represented schematically at 22 by a dotted line. In the present embodiment, the linkage 22 is arranged to move the two throttles through the same throttle angle at all times, hence it may be formed of a gear system or a system of levers. The on/off valve 30 is associated with an actuator 32 which may be an electric or a pneumatic motor for moving the on/off valve 30 between fully closed and fully open positions. The size of the on/off valve 30 is such that when it is open, it effectively applies the ambient atmospheric pressure to the first throttle 10 and the first throttle 10 alone determines the Through-flow cross-section of the intake system. When the on/off valve 30 is closed, on the other hand, the through-flow cross-section of the intake system is determined by the series combination of the first and the second throttles 10 and 20.

The second throttle is sized smaller than the first throttle 10 so that when it is brought into action by closing of the on/off valve 30, the air supply to the engine is abruptly reduced.

The intake system of FIG. 1 therefore operates in a manner analogous to that disclosed in WO96/21097 in that if an on/off valve is operated while the demand pedal is maintained in the same position, the air mass supplied to the engine undergoes an abrupt change. If the rate of fuel supplied to the engine is correctly modified in synchronism with the change in intake air mass, it is possible to switch between a lean burn mode and a stoichiometric mode without any perceptible change in engine torque.

Figure 3:
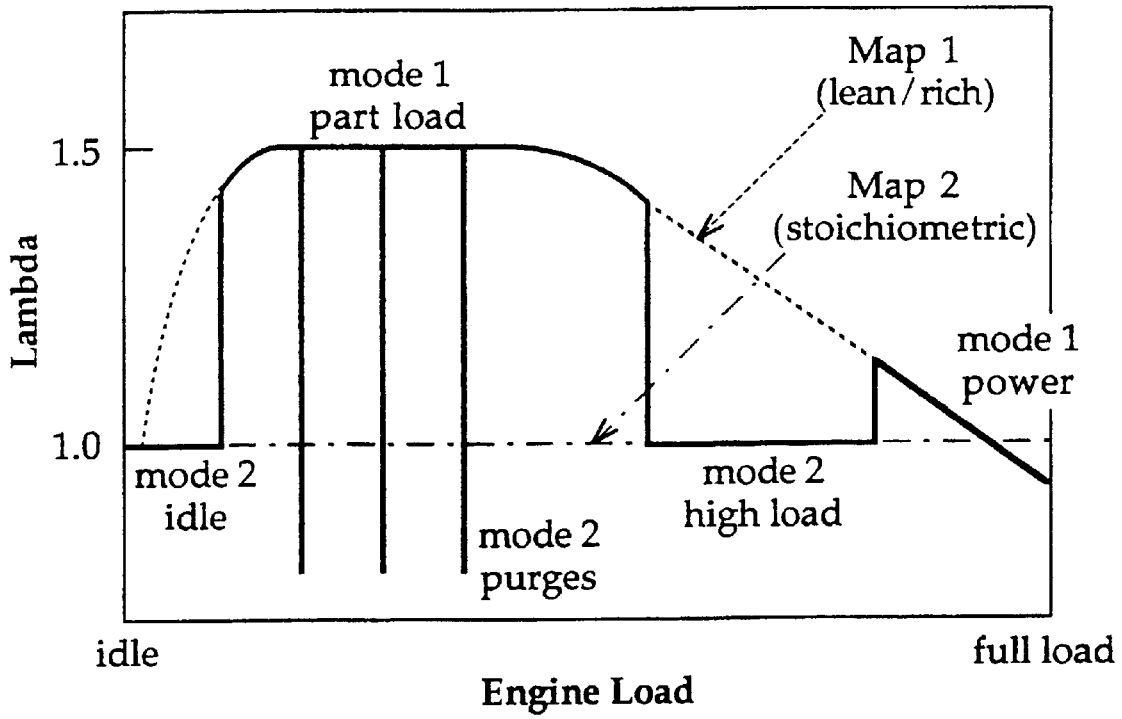
FIG. 3 is a map of AFR against engine load to show the mode switching between lean burn mode and stoichiometric mode in a lean burn engine.

The operation of an engine fitted with the intake system of FIG. 1 can be better understood with reference to FIG. 3 in which the calibration of the relative air/fuel ratio (lambda) is plotted against engine load for a given engine speed. The complete calibration for the engine will comprise several such maps at different engine speeds. The horizontal line at lambda 1 (partly solid and partly chain-dotted) that is designated Map 2 corresponds to stoichiometric mode operation. The upwardly convex line designated Map 1 that peaks at lambda 1.5 (partly solid and partly dotted) corresponds to lean burn mode and power mode operations. If the calibrations of the maps 1 and 2 are correctly performed, then switching between the two maps (by following any vertical line) at the same time as the on/off valve 30 is actuated will cause no change in engine torque.

The solid line portions of the two maps in FIG. 3 indicate the preferred control strategy. In particular, the engine idles at stoichiometry, switches to lean burn during part load, reverts to stoichiometry at moderately high load and eventually operates in a rich mode region of Map 1 at full load. The reason for switching to Map 1 at full load is that Map 2 relies on the second throttle 20 being effective which limits the breathing of the engine, whereas for Map 1 only the first throttle 10 limits the breathing of the engine. It is for this reason that it is important that the sum of the areas A2 and A3 of the second throttle 20 and the on/off valve 30 should exceed the area A1 of the first throttle 10. The switching into the power mode can take place at a preset position of the first throttle 10 as sensed by the throttle position sensor 18.

The above strategy achieves smooth running during idle, improved fuel economy during part load, and maximum performance at high load. Furthermore during lean burn operation, one can briefly flick into a stoichiometric or rich mode to purge an NOx trap in the exhaust system.

In calibrating the lean burn Map 1 on an engine dynamometer to maintain constant torque during mode changes, the computed fuel will not only compensate for the change in the intake air mass caused by switching the on/off valve 30, but will also take into account lesser effects such as simultaneous or consequential changes in manifold vacuum, pumping work, thermal efficiency, spark timing, exhaust gas recirculation etc.

In common with the proposal in WO96/21097, a simple mechanism is provided to achieve seamless mode changes. If, at the same time as operating the on/off valve 30, the fuel calibration is changed by switching between Map 1 and Map 2, then regardless of the prevailing load and speed conditions of the engine, the mode change will not be perceived by the driver who will not need to modify the demand pedal position in any way as a consequence.

The advantage of the system of the present invention over the proposal in WO96/21097 is that the tolerance required in the second throttle 20 and the on/off valve 30 is not as great as that required in the first throttle 10. The reason for this is that when the on/off valve 30 is open, the upstream pressure at the first throttle 10 is ambient pressure and it is of no importance if leakage occurs past the second throttle 20. When the on/off valve 30 is closed on the other hand, as would be the case during idling, air leakage past the second throttle 20 will not affect the idle speed which still remains under the control of the idle speed controller 16 across the first throttle 10.

Indeed it is desirable intentionally to reduce the tolerance requirements on the second throttle 20 and the on/off valve 30 to avoid icing, sludge and other causes of jamming. This not only improves reliability but reduces manufacturing cost.

Figure 2:
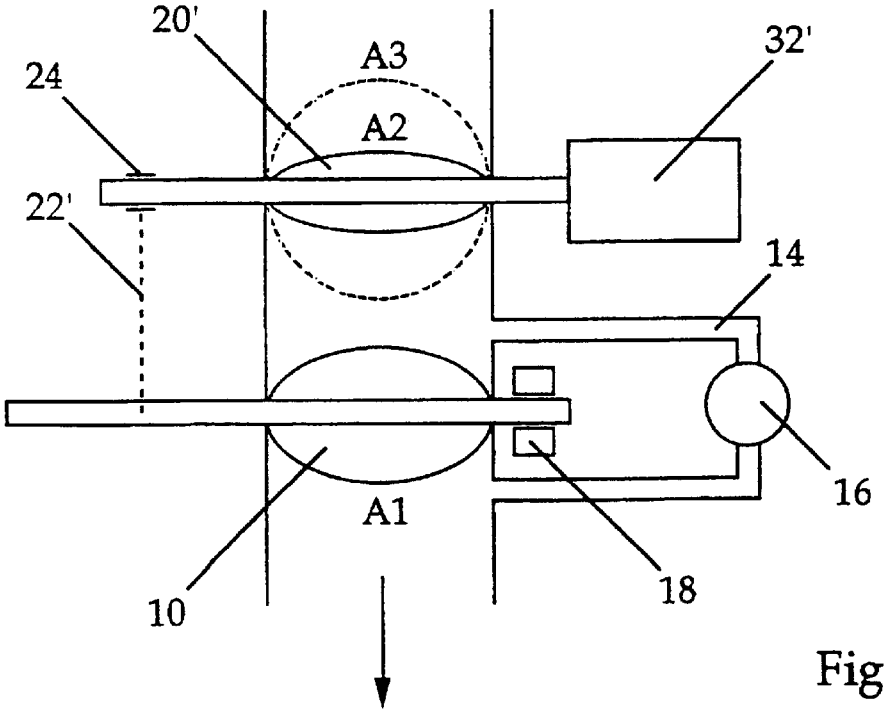
FIG. 2 is a block diagram of an intake system of a second embodiment of the invention.

The embodiment of FIG. 2 in terms of the air flow to the engine is identical with that of FIG. 1 but instead of opening an on/off valve 30 in parallel with the second throttle 20 when it is desired to disable the second throttle 20, the second throttle is itself moved to a wide open position achieving the same objective of applying the ambient pressure upstream of the first throttle 10.

The first throttle 10, the bypass passage 14, the idle speed controller 16 and the throttle position sensor 18 in FIG. 2 are the same as previously described by reference to FIG. 1. The second throttle 20' is of a larger diameter than the second throttle 20 of the first embodiment and is connected to the first throttle 10 by a modified linkage 22'. In this embodiment, the first and second throttles 10 and 20' are not moved by the same throttle angle, the second throttle 20' being turned through a lesser angle to achieve the same through-flow cross-section as that of the smaller second throttle 20 in FIG. 1.

In FIG. 2, an override mechanism allows the second throttle 20' to be moved to a wide open position whenever desired. The override mechanism comprising a lost-motion coupling 24 with a stop that defines the partially closed position set by the linkage 22' in one direction while allowing the second throttle 20' to be opened fully in the opposite direction. The actuating motor 32' will in this case either bias the second throttle 20' towards the partially closed position set by the linkage 22' or to the wide open position depending on the stoichiometric or lean mode of operation respectively.

The maximum through-flow cross-section A3 of the second throttle 20' when it is fully open must exceed the through-flow cross-section A1 of the first throttle 10 in order not to limit the breathing of the engine at full load.

What is claimed is:

1. An intake system for a lean burn engine comprising a first throttle connected to a manifold leading to the engine, a second throttle (20) connected in series with and upstream of the first throttle (10) and linked for movement in synchronism with the first throttle (10), and a mode control means (30,32) for changing between lean burn and stoichiometric modes by abruptly altering the pressure drop across the second throttle (20) to transfer control of the effective through-flow cross-section of the intake system between the first throttle (10) alone and the series combination of the two throttles (10,20).

2. An intake system as claimed in claim 1, wherein the engine is provided with two air/fuel ratio calibration maps, the first map for use when the first throttle controls the effective through-flow cross-section of the intake system, and the second map for use when the series combination of the first and second throttles controls the effective through-flow cross-section of the intake system, the air/fuel ratio settings of the two maps at the same operating point (same speed and load) on the two maps being such that the output torque of the engine remains the same during a mode change.

3. An intake system as claimed in claim 2, wherein the air/fuel ratio setting on the first map is calibrated at leaner than stoichiometry over the part load region of the map and is ramped towards stoichiometry at the high load region of the map and is richer than stoichiometry at substantially the full load region of the map and wherein the air/fuel ratio setting on the second map is calibrated at stoichiometry over substantially the entire region of the map.

4. An intake system as claimed in claim 2, wherein the calibration maps in addition to allowing for the change in air flow during mode changes, take into account changes in other parameters affecting the output torque of the engine.

5. An intake system as claimed in claim 4, wherein the mode control means includes an on/off valve (30) connected in parallel with only the second throttle (20).

6. An intake system as claimed in claim 5, wherein the maximum through-flow cross-section of the second throttle (20) is smaller than the maximum through-flow cross-section of the first throttle (10).

7. An intake system as claimed in claim 6, wherein the combined maximum through-flow cross-section of the second throttle (20) and the on/off valve (30) when it is open is at least equal to the maximum through-flow cross-section of the first throttle (10).

8. An intake system as claimed in claim 4, wherein the mode control means comprises an override mechanism (32') for temporarily disengaging the linkage between the second throttle (20') and the first throttle (10) and fully opening the second throttle (20').

9. An intake system as claimed in claim 8, wherein the maximum through-flow cross-section of the second throttle (20') is at least equal to the maximum through-flow cross-section of the first throttle (10).

10. An intake system as claimed in claim 1, wherein the first (10) and second (20,20') throttles are butterfly throttles.

11. An intake system as claimed in claim 5, wherein the second throttle (20) is ganged with the first throttle (10) for movement through the same throttle angle.

12. An intake system as claimed in claim 8, wherein the second throttle (20') is linked with the first throttle (10) for movement through a smaller throttle angle than the first throttle (10).

13. An intake system as claimed in claim 1, wherein the mode control means is actuated electrically or pneumatically.

* * * * *